US010841710B1

(12) United States Patent
Lee et al.

(10) Patent No.: US 10,841,710 B1
(45) Date of Patent: Nov. 17, 2020

(54) PACKAGE STRUCTURE OF MICRO-ELECTRO-MECHANICAL-SYSTEM MICROPHONE PACKAGE AND METHOD FOR PACKAGING THE SAME

(71) Applicant: Solid State System Co., Ltd., Hsinchu (TW)

(72) Inventors: Chien-Hsing Lee, Hsinchu County (TW); Tsung-Min Hsieh, New Taipei (TW); Cheng-Wei Tsai, Taichung (TW)

(73) Assignee: Solid State System Co., Ltd., Hsinchu (TW)

( * ) Notice: Subject to any disclaimer, the term of this patent is extended or adjusted under 35 U.S.C. 154(b) by 28 days.

(21) Appl. No.: 16/446,646

(22) Filed: Jun. 20, 2019

(51) Int. Cl.

| | |
|---|---|
| ***H04R 25/00*** | (2006.01) |
| ***H04R 19/04*** | (2006.01) |
| ***H04R 31/00*** | (2006.01) |
| ***H04R 1/04*** | (2006.01) |

(52) U.S. Cl.
CPC ..... *H04R 19/04* (2013.01); *H04R 1/04* (2013.01); *H04R 31/003* (2013.01); *H04R 2201/003* (2013.01)

(58) Field of Classification Search
CPC ..... H04R 19/04; H04R 1/04; H04R 31/003; H04R 2201/003
USPC ..... 381/174
See application file for complete search history.

(56) References Cited

FOREIGN PATENT DOCUMENTS

| | | | | |
|---|---|---|---|---|
| CN | 104779213 A | * | 7/2015 | ..... H01L 23/10 |
| CN | 205566635 U | * | 9/2016 | |

* cited by examiner

*Primary Examiner* — Phylesha Dabney
(74) *Attorney, Agent, or Firm* — JCIPRNET

(57) ABSTRACT

A package structure of MEMS microphone is provided. The MEMS microphone includes a MEMS microphone chip disposed on a circuit board. The MEMS microphone chip comprises a first bonding pad, including a metal pad on a top of the MEMS microphone chip; and a protection layer fully enclosing a sidewall of the metal pad and also partially disposed on a top of the metal pad. A circuit chip is disposed on the circuit board, wherein the circuit chip comprises a second bonding pad. A bonding wire is connected between the first bonding pad and the second bonding pad.

22 Claims, 8 Drawing Sheets

PACKAGE STRUCTURE OF MICRO-ELECTRO-MECHANICAL-SYSTEM MICROPHONE PACKAGE AND METHOD FOR PACKAGING THE SAME

BACKGROUND

1. Field of the Invention

The invention is related to MEMS (Micro Electro Mechanical System) microphone package technology, and particularly related to the package structure of MEMS microphone and the method for packaging the same.

2. Description of Related Art

Microphone has been designed based on semiconductor fabrication technology, so as to greatly reduce the size. The MEMS microphone is a popular device used in electronic apparatus to sense acoustic signals, such as the communication voice.

After the MEMS microphone chips are fabricated on a wafer and cut into multiple chips, the MEMS microphone in single chip is connected to an integrated circuit, such as an application-specific integrated circuit (ASIC), by packaging process.

As to the packaging process, once the MEMS microphone chip and the ASIC chip are separately fabricated, they are disposed on a circuit board. Then, the wire bonding process is performed to connected together to form a MEMS microphone for adapting into various applications. Actually, each of the MEMS microphone chip and the ASIC chip has bonding pads. The wire bonding process are bonding between the bonding pads of the MEMS microphone chip and the ASIC chip.

However, due to usual fabrication manner as taken to fabricate the MEMS microphone chip, material of the bonding pads of the MEMS microphone chip is based on aluminum. Then, the aluminum bonding pad may be suffer corrosion, resulting in damage.

How to package the MEMS microphone to effectively avoid the corrosion on the bonding pad of the MEMS microphone chip is an issue in the packaging process.

SUMMARY OF THE INVENTION

The invention provides a package structure of MEMS microphone and the packaging method thereof. The bonding pad of the MEMS microphone may be well protected to reduce the corrosion of the bonding pad.

In an embodiment, the invention provides a package structure of MEMS microphone. The MEMS microphone includes a MEMS microphone chip disposed on a circuit board. The MEMS microphone chip comprises a first bonding pad, including a metal pad on a top of the MEMS microphone chip; and a protection layer fully enclosing a sidewall of the metal pad and also partially disposed on a top of the metal pad. A circuit chip is disposed on the circuit board, wherein the circuit chip comprises a second bonding pad. A bonding wire is connected between the first bonding pad and the second bonding pad.

In an embodiment, the invention provides a package structure of MEMS microphone, comprising a MEMS microphone chip, disposed on a circuit board, wherein the MEMS microphone chip comprises a first bonding pad, the first bonding pad is located on a top of the MEMS microphone chip. A circuit chip is disposed on the circuit board, wherein the circuit chip comprises a second bonding pad. A bonding wire is connected between the first bonding pad and the second bonding pad. A sealant structure is locally covering on the first bonding pad and an end portion of the bonding wire on the first bonding pad.

In an embodiment, the invention provides a method for packaging MEMS microphone, comprising: providing a circuit board, a MEMS microphone chip and a circuit chip, wherein the MEMS microphone chip comprises a first bonding pad, the circuit chip comprises a second bonding pad. The first bonding pad comprises: a metal pad on a top of the MEMS microphone chip; and a protection layer fully enclosing a sidewall of the metal pad and also partially disposed on a top of the metal pad. In addition, the MEMS microphone chip and the circuit chip are disposed on the circuit board. A bonding process is performed to connect between the first bonding pad and the second bonding pad by a bonding wire.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

The invention is directed to a structure of MEMS microphone package and a method for packaging the MEMS microphone. The bonding pad of the MEMS microphone chip may be well protected from corrosion.

Several embodiments are provided for describing the invention but the invention is not limited to the embodiments as provided. Further, a proper combination between the embodiments may also be further done.

Figure 1:
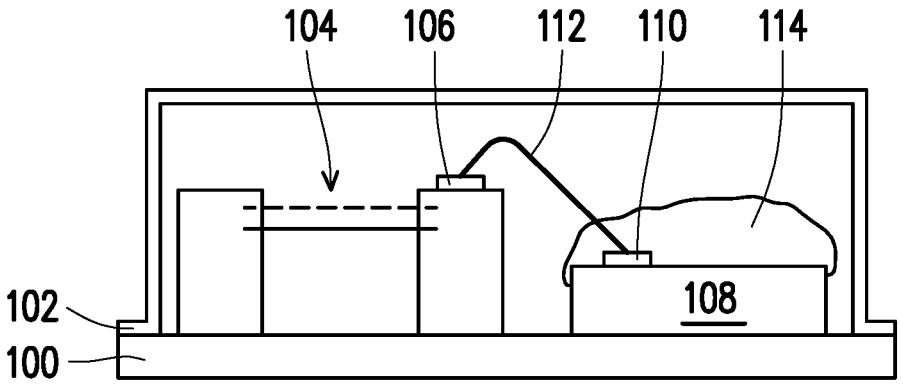
FIG. 1 schematically illustrating a package structure of MEMS microphone as looked into, according to an embodiment of the invention.

The invention has looked into the package structure of MEMS microphone, so to improve the quality of the MEMS microphone. FIG. 1 schematically illustrating a package structure of MEMS microphone as looked into, according to an embodiment of the invention.

Referring to FIG. 1, the MEMS microphone chip 104 and the circuit chip 108 are separately fabricated based on the semiconductor fabrication technology. The MEMS microphone chip 104 and the circuit chip 108, such as ASIC chip, need to be packaged onto a circuit board 100 with the boding wire 112 to connect between the boding pad 106 on the MEMS microphone chip 104 and the bonding pad 110 on the circuit chip 108. Other bonding pads 110 on the circuit chip 108 may be further connected to the circuit board 100. The bonding pad 106 in local area is usually at an exposed state. However, the top of the circuit chip 108 may be protected by globe top structure 114 to fully cover the top surface of the circuit chip 108, including the boding pad 110 and the end portion of the bonding wire 112.

The bonding pad 106 with the bonding wire 112 of the MEMS microphone chip 104 is usually exposed, in which the bonding pad 106 is aluminum pad. After then, a cap 102 covers the MEMS microphone chip 104 and the circuit chip 108 for protection.

Here, the structure of the MEMS microphone chip 104 is formed depending on the actual design without specific limitation. However, it basically includes a backplate and a diaphragm. The backplate has venting holes to pass the acoustic signal and also aha the electrode structure. The diaphragm receives the acoustic signal and vibrate correspondingly, so to change the capacitance level with the acoustic frequency. The circuit in the backplate converts the capacitance effect into electric signals to the circuit chip 108 for subsequent application.

Figure 2:
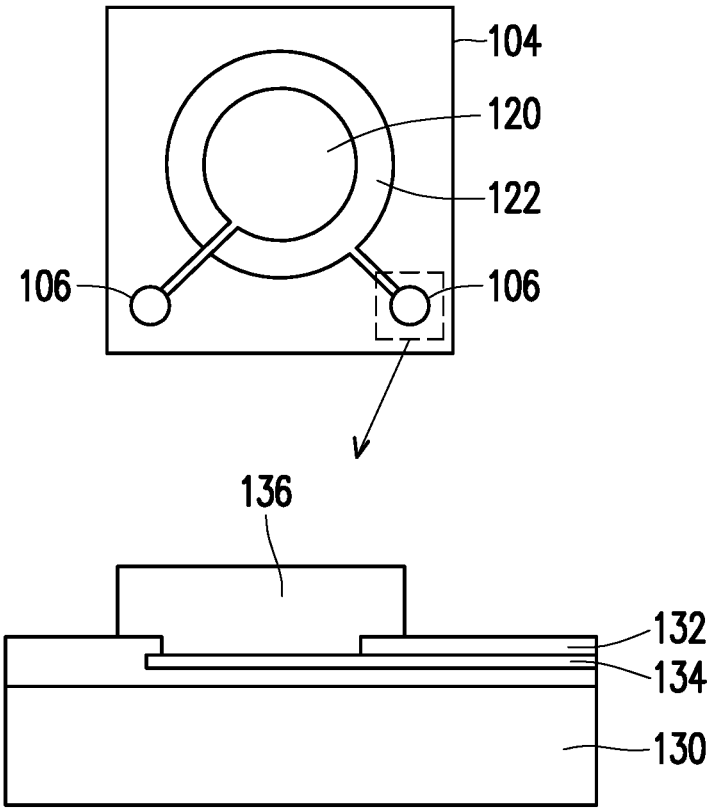
FIG. 2 schematically illustrating a structure of the bonding pad on the MEMS microphone chip before bonding process, according to an embodiment of the invention.

FIG. 2 schematically illustrating a structure of the bonding pad on the MEMS microphone chip before bonding process, according to an embodiment of the invention. Referring to FIG. 2, a top view of the MEMS microphone chip 104 is shown at the upper part. Two boding pads 106 are respectively connected to the diaphragm 120 and the backplate 122 to lead out the cathode electrode and the anode electrode.

A cross-sectional structure of the boding pad 106 is shown at the lower part of FIG. 2. The circuit layer 134 with the inter-layer dielectric layer 132 is disposed on a silicon substrate 130, which is also a portion of the silicon substrate involved in the MEMS microphone chip 104. The circuit layer 134 is connected to the corresponding electrode of the MEMS microphone chip 104. For the usual structure of the boding pad in fabrication, a metal pad 136 is formed on the inter-layer dielectric layer 132 and contacts to the circuit layer 134. The metal pad 136 usually is the aluminum pad.

Figure 3:
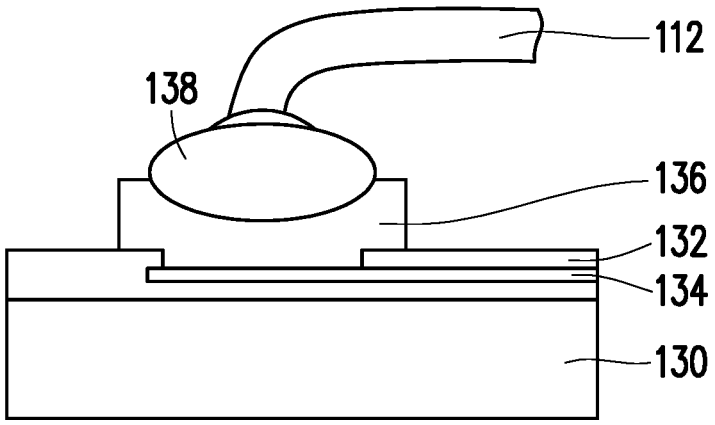
FIG. 3 schematically illustrating a structure of the bonding pad on the MEMS microphone chip after bonding process, according to an embodiment of the invention.

FIG. 3 schematically illustrating a structure of the bonding pad on the MEMS microphone chip after bonding process, according to an embodiment of the invention. Referring to FIG. 3, a bonding process is performed to connect the bonding pad 106 by the bonding wire 112. The end portion 138 of the binding wire 112 is a melted structure, firmly adhering to the metal pad 136.

Figure 4:
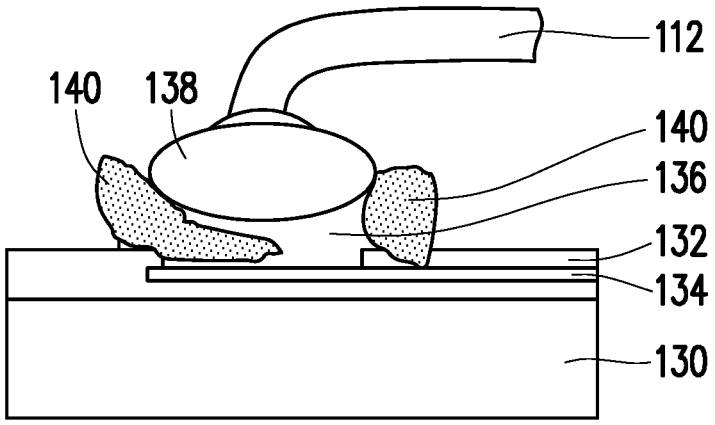
FIG. 4 schematically illustrating an issue for the structure of the bonding pad on the MEMS microphone chip after bonding process, according to an embodiment of the invention.

FIG. 4 schematically illustrating an issue for the structure of the bonding pad on the MEMS microphone chip after bonding process, according to an embodiment of the invention. Referring to FIG. 4, material of the metal pad 136 usually is aluminum or generally containing aluminum. As known, aluminum is easy to be corroded by Cl/F, acid or environmental moisture in an example. The corrosion may impact the reliability of MEMS microphone in high temperature and humidity environment. However, the metal pad 136 of the MEMS microphone chip is usually not covered by glob top material in a small area locally over the metal pad for protection. As known, the diaphragm for vibrating function should not be covered but glob top material. In this situation for the convention option, the metal pad 136 is not at the exposed state. As a result, the metal pad 136 s corroded into rust-like material 140.

Figure 5:
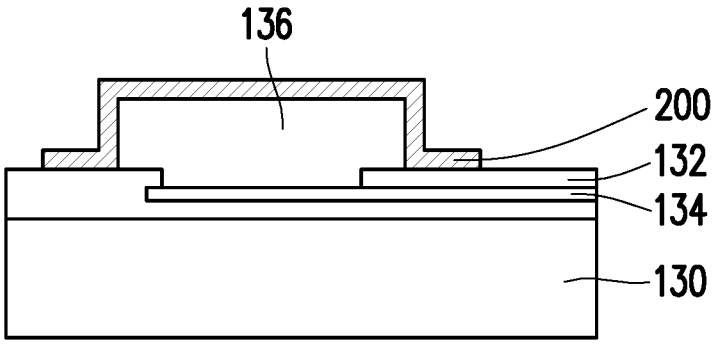
FIG. 5 schematically illustrating a structure of the bonding pad on the MEMS microphone chip before bonding process, according to an embodiment of the invention.

After looking into the metal pad 136 described above, the invention in an embodiment has proposed some embodiments to effectively protect the metal pad. FIG. 5 schematically illustrating a structure of the bonding pad on the MEMS microphone chip before bonding process, according to an embodiment of the invention.

Referring to FIG. 5, taking the structure od metal pad 136 in FIG. 2 as an example, the invention has proposed a conductive protection layer 200 in an embodiment. The conductive protection layer 200 may be TiN in an embodiment. In the stage before the bonding process, the conductive protection layer 200 in an embodiment is fully covering the sidewall and the top of the metal pad 136. The conductive protection layer 200 may be thin but serves a barrier to the environment from corrosion on the metal pad 136, such as the aluminum pad in an example. As to described later, the bonding wire in the bonding process may still be able to penetrate the protection layer 200 to firmly bond to the metal pad 136. In the embodiment, the conductive protection layer 200 in general may be treated as a protection layer.

Figure 6:
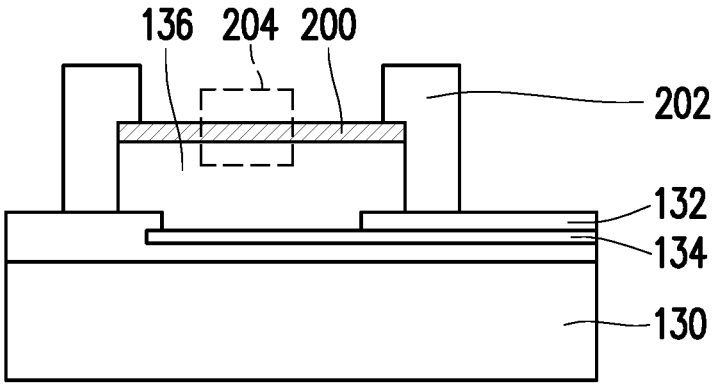
FIG. 6 schematically illustrating a structure of the bonding pad on the MEMS microphone chip before bonding process, according to an embodiment of the invention.

In another embodiment, the conductive protection layer 200 may be modified. FIG. 6 schematically illustrating a structure of the bonding pad on the MEMS microphone chip before bonding process, according to an embodiment of the invention. Referring to FIG. 6, the conductive protection layer 200 may just cover the top of the metal pad 136. However, the sidewall of the metal pad 136 may be covered by the dielectric layer 202. In this situation, the conductive protection layer 200 with the dielectric layer 202 in general may be treated as a protection layer.

For the general protection layer on the metal pad 136, the conductive protection layer 200 is at least disposed on top of the metal pad 136. The sidewall of the metal pad 136 may be covered by the same conductive layer 200 in FIG. 5 or covered by the dielectric layer 202 in FIG. 6.

Figure 7:
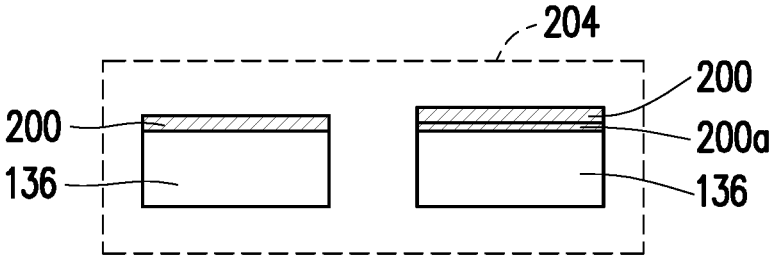
FIG. 7 schematically illustrating a structure of the bonding pad on the MEMS microphone chip before bonding process, according to an embodiment of the invention.

To the conductive layer 200, it may also be further modified in an embodiment. FIG. 7 schematically illustrating a structure of the bonding pad on the MEMS microphone chip before bonding process, according to an embodiment of the invention. Taking a portion 204 of the conductive protection layer 200 in FIG. 6, in an embodiment, the conductive protection layer 200 may be a single-layer conductive layer or a staked layer including the conductive protection layer 200 and a conductive glue layer **200*a*, such as Ti layer. The glue layer 200*a* improve the adhesion between the conductive protection layer 200 and the metal pad 136**.

Figure 8:
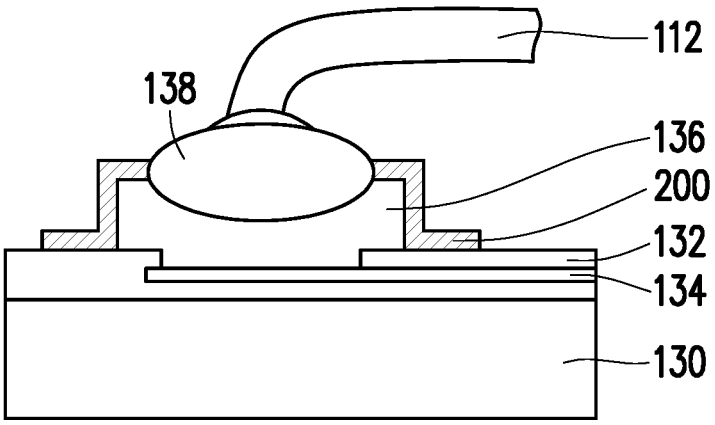
FIG. 8 schematically illustrating a structure of the bonding pad on the MEMS microphone chip after bonding process, according to an embodiment of the invention.

FIG. 8 schematically illustrating a structure of the bonding pad on the MEMS microphone chip after bonding process, according to an embodiment of the invention. Referring to FIG. 8, a boding process is performed on the metal pad 136 with the conductive protection layer 136 in FIG. 5. As a result, the end portion 138 of the bonding wire 112 penetrate the conductive protection layer 200 and is firmly bonded to the metal pad 136. In this structure, a portion of the conductive protection layer 200 on the top of the metal pad 136 would enclose the end portion 138 of the bonding wire 112. The conductive protection layer 200 also enclose the sidewall of the metal pad 136 to well protect the metal pad 136 from corrosion.

Figure 9:
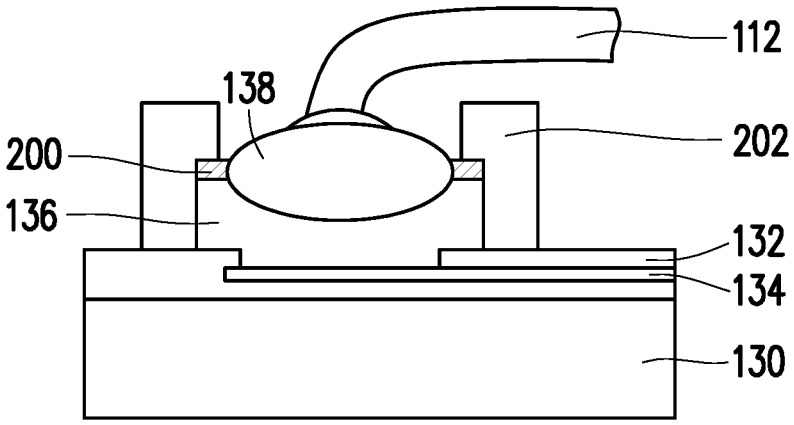
FIG. 9 schematically illustrating a structure of the bonding pad on the MEMS microphone chip after bonding process, according to an embodiment of the invention.

FIG. 9 schematically illustrating a structure of the bonding pad on the MEMS microphone chip after bonding process, according to an embodiment of the invention. Referring to FIG. 9 in a further embodiment based on the structure in FIG. 6, the sidewall of the metal pad 136 is covered by the dielectric layer 202. However, the top of the metal pad 136 with the conductive protection layer 200 is still exposed before the bonding process. After the bonding process, the end portion 138 of the bonding wire 112 is also firmly bonded to the metal pad 136. In an embodiment, according to a fabrication process, the dielectric layer 202 may also coverer the peripheral region of the protection conductive layer 200 on the top of the metal pad 136.

Figure 10A:
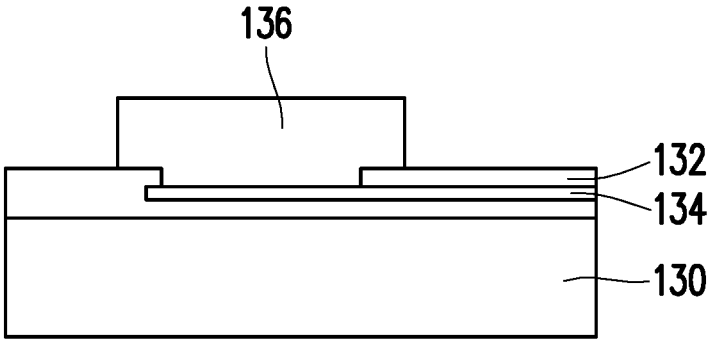
FIGS. 10A-10C schematically illustrating a packaging process, according to an embodiment of the invention.

Multiple embodiment to form the metal pad 136 are also provided. FIGS. 10A-1C schematically illustrating a packaging process, according to an embodiment of the invention. Referring to FIG. 10A, in an embodiment, a structure of the metal pad 136 based on the structure in FIG. 2 is provided.

Figure 10B:
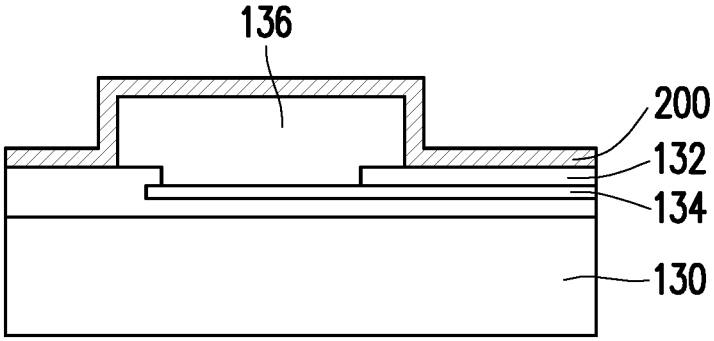
Figure 10C:
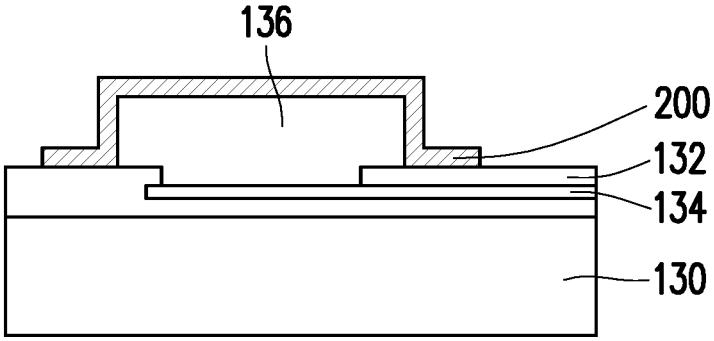

Referring to FIG. 10B, a conductive protection layer 200 is formed to cover on the metal pad 136. Referring to FIG. 10C, a side portion of the conductive protection layer 20 is removed. A residual portion of the conductive protection layer 200 serves as a final structure to fully cover the top and a sidewall of the metal pad 136. For the subsequent bonding process, as shown in FIG. 8, an end portion 138 of the bonding wire 112 in the bonding process is penetrating the conductive protection layer 200 and connected to the metal pad 136.

Figure 11A:
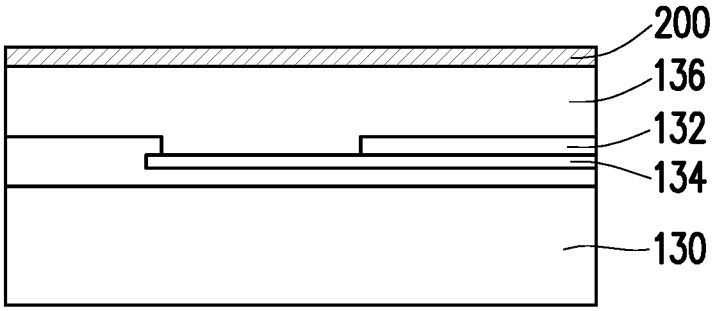
FIGS. 11A-11D schematically illustrating a packaging process, according to an embodiment of the invention.
Figure 11B:
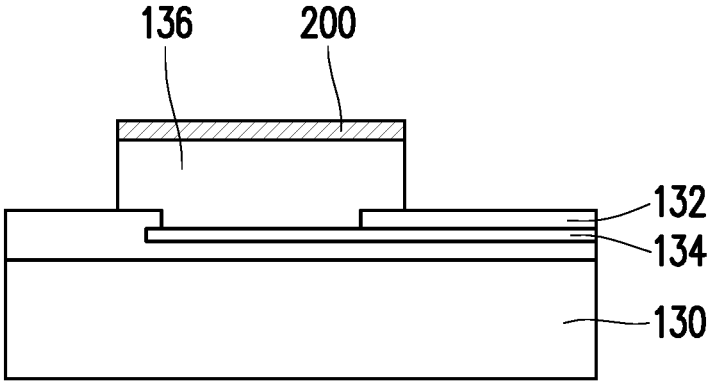

In an embodiment, the conductive protection layer 200 may be further modified. FIGS. 11A-11D schematically illustrating a packaging process, according to an embodiment of the invention. Referring to FIG. 11A, a preliminary metal layer of the metal pad 136 and a preliminary conductive layer for the conductive protection layer 200 are sequentially formed over the silicon substrate 130 of the MEMS microphone chip, without being patterned into the actual size yet. Referring to FIG. 11B, the preliminary metal layer and the preliminary conductive layer are patterned to respectively form the metal pad 136 and the conductive protection layer 200. In the embodiment, the conductive protection layer 200 just covers the top of the metal pad 136 to serve as a part of the general protection layer at the later stage.

Figure 11C:
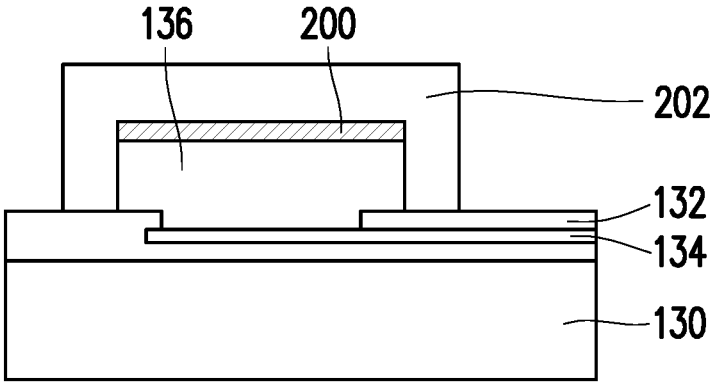
Figure 11D:
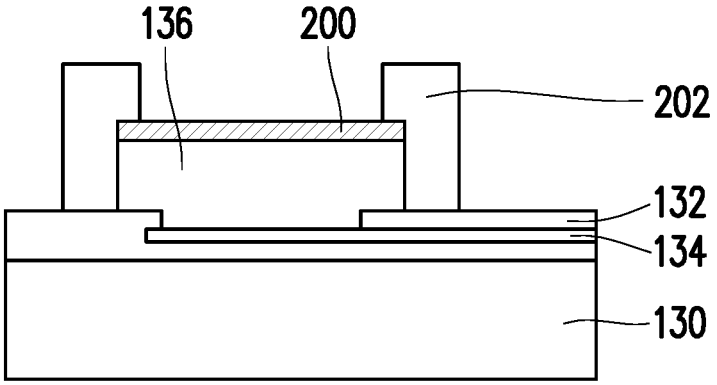

Referring to FIG. 11C, to protect the sidewall of the metal pad 136, a dielectric layer 202 may be formed to fully cover over the metal pad 136 and the conductive protection layer 200. Referring to FIG. 11D, the dielectric layer 202 is further patterned to have an opening to expose the conductive protection layer 200.

The structure in FIG. 11D may be subsequently performed with the bonding process to have the structure in FIG. 9. An end portion 138 of the bonding wire 112 in the bonding process within the opening is penetrating the conductive protection layer 200 and connected to the metal pad 136. As a result, the dielectric layer 202 with the conductive protection layer 200 forms a general protection layer on the metal pad 136.

As noted in referring to FIG. 7 as well, the conductive protection layer in FIGS. 10A-10C and 11A-11D may be a single-layer conductive layer or a conductive layer with a glue layer on the metal pad.

Figure 12:
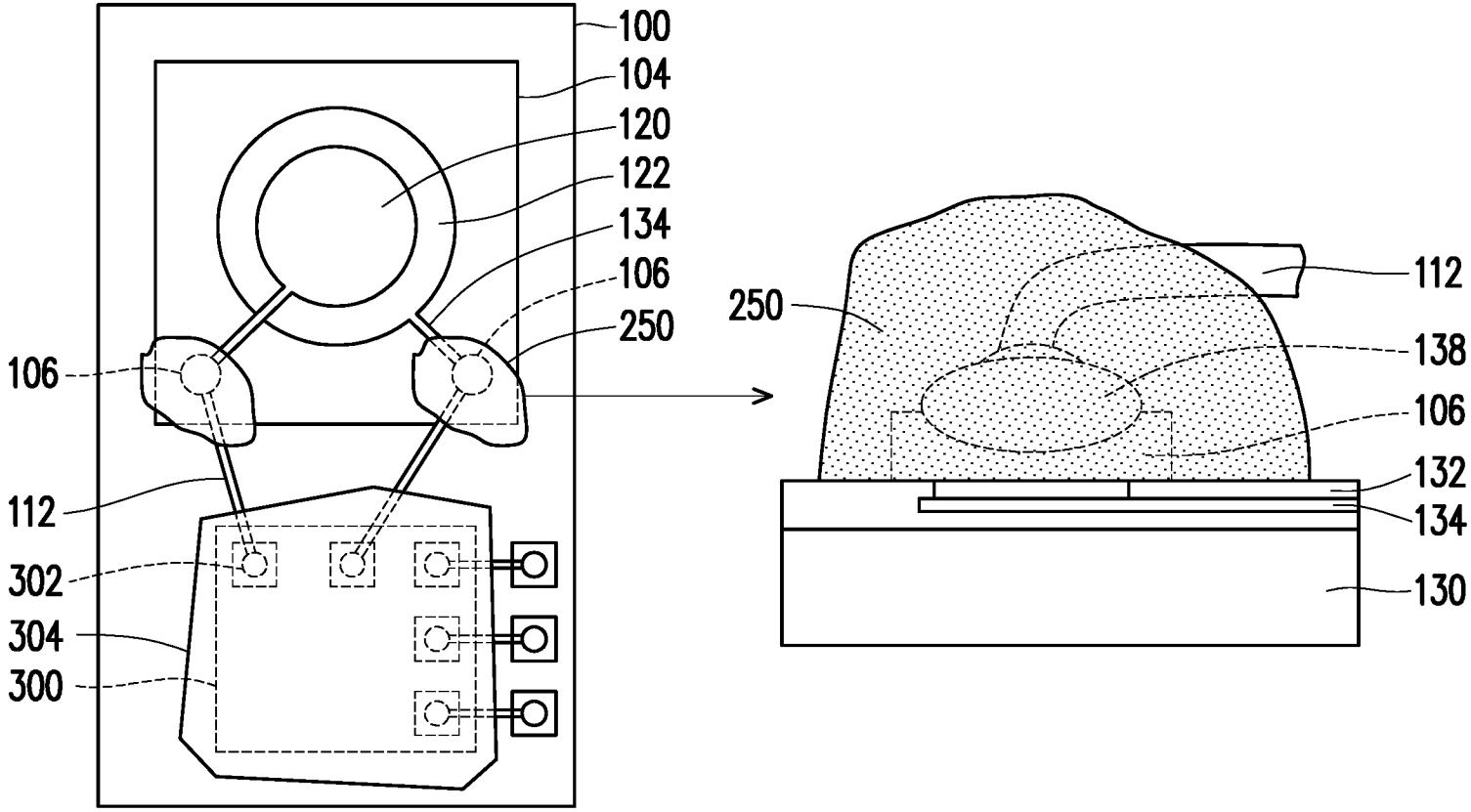
FIG. 12 schematically illustrating a structure of the bonding pad on the MEMS microphone chip after bonding process, according to an embodiment of the invention.

In a further embodiment, FIG. 12 schematically illustrating a structure of the bonding pad on the MEMS microphone chip after bonding process, according to an embodiment of the invention.

Referring to FIG. 12, as also previously described, the MEMS microphone chip 108 and the circuit chip 300 are separately fabricated based on the semiconductor fabrication technology. In packaging stage, the MEMS microphone chip 104 and the circuit chip 108 are disposed on the circuit board 100. The bonding pads 106 serving as the electrode terminals of the MEMS microphone chip 104 are connected to the diaphragm 120 and the backplate 122 through the circuit layer 134. The bonding pads 302 of the circuit chip 300 are then connected to bonding pads 106 of the MEMS microphone chip 104 by the bonding wires 112.

Usually, the circuit chip 300 is a bulk structure and the glob top 304 for sealing in a large area is easily applied on the top to have fully protection on the circuit chip 300. However, the MEMS microphone chip 108 including the diaphragm 120 in the conventional manner is not applied with the glob top structure. As looking into FIG. 4, the bonding pad 106 with aluminum pad in an example is easily corroded by the environment. The invention proposed that the glob top structure 250 under properly control in amount and location of the sealant material, such as the glob top material may be locally applied on the bonding pads 106 without causing the glob top material to flow into the main part of the MEMS microphone chip 104.

As to the foregoing descriptions, the invention in embodiments may be generally stated as follows.

In an embodiment, the invention provides a package structure of MEMS microphone. The MEMS microphone includes a MEMS microphone chip disposed on a circuit board. The MEMS microphone chip comprises a first bonding pad, including a metal pad on a top of the MEMS microphone chip; and a protection layer fully enclosing a sidewall of the metal pad and also partially disposed on a top of the metal pad. A circuit chip is disposed on the circuit board, wherein the circuit chip comprises a second bonding pad. A bonding wire is connected between the first bonding pad and the second bonding pad.

In an embodiment, as to the package structure, the metal pad contains aluminum and the protection layer contains TiN.

In an embodiment, as to the package structure, the protection layer provides a barrier capability from corrosion of the metal pad.

In an embodiment, as to the package structure, the MEMS microphone chip comprise: a silicon substrate; a MEMS structure, disposed on the silicon substrate; a circuit layer, disposed on the silicon substrate, the circuit layer connected to the MEMS structure; and the first boding pad, disposed on the circuit layer.

In an embodiment, as to the package structure, the bonding wire is a gold wire.

In an embodiment, as to the package structure, the first boding pad comprises an anode pad and a cathode pad of the MEMS microphone chip.

In an embodiment, as to the package structure, an end portion of the bonding wire is disposed on the top of the metal pad and the protection layer comprises a conductive layer at least covering on the top of the metal pad enclosing the end portion of the bonding wire.

In an embodiment, as to the package structure, the conductive layer further comprises a portion fully enclosing the sidewall of the metal pad.

In an embodiment, as to the package structure, the protection layer further comprises a dielectric layer fully enclosing the sidewall of the metal pad.

In an embodiment, as to the package structure, the dielectric layer further covers a peripheral region of the conductive layer on the top of the of the metal pad.

In an embodiment, as to the package structure, the conductive layer contains TiN and the metal pad contains aluminum.

In an embodiment, as to the package structure, the protection layer comprises a single-layer conductive layer or a conductive layer with a glue layer on the metal pad.

In an embodiment, the invention provides a package structure of MEMS microphone, comprising a MEMS microphone chip, disposed on a circuit board, wherein the MEMS microphone chip comprises a first bonding pad, the first bonding pad is located on a top of the MEMS microphone chip. A circuit chip is disposed on the circuit board, wherein the circuit chip comprises a second bonding pad. A bonding wire is connected between the first bonding pad and the second bonding pad. A sealant structure is locally covering on the first bonding pad and an end portion of the bonding wire on the first bonding pad.

In an embodiment, as to the package structure, the bonding pad contains aluminum.

In an embodiment, as to the package structure, the sealant structure comprises a glob top structure.

In an embodiment, the invention provides a method for packaging MEMS microphone, comprising: providing a circuit board, a MEMS microphone chip and a circuit chip, wherein the MEMS microphone chip comprises a first bonding pad, the circuit chip comprises a second bonding pad. The first bonding pad comprises: a metal pad on a top of the MEMS microphone chip; and a protection layer fully enclosing a sidewall of the metal pad and also partially disposed on a top of the metal pad. In addition, the MEMS microphone chip and the circuit chip are disposed on the circuit board. A bonding process is performed to connect between the first bonding pad and the second bonding pad by a bonding wire.

In an embodiment, as to the method for packaging MEMS microphone, the metal pad contains aluminum and the protection layer contains TiN.

In an embodiment, as to the method for packaging MEMS microphone, the protection layer provides a barrier capability from corrosion of the metal pad.

In an embodiment, as to the method for packaging MEMS microphone, an end portion of the bonding wire in the bonding process is disposed on the top of the metal pad and the protection layer comprises a conductive layer at least covering on the top of the metal pad enclosing the end portion of the bonding wire.

In an embodiment, as to the method for packaging MEMS microphone, the MEMS microphone chip is provided by: forming the metal pad on the top of the MEMS microphone chip; forming a conductive layer, covering on the MEMS microphone chip and the metal pad; removing a side portion of the conductive layer. A residual portion of the conductive layer serves as the protection layer to fully cover the top and a sidewall of the metal pad. an end portion of the bonding wire in the bonding process is penetrating the protection layer and connected to the metal pad.

In an embodiment, as to the method for packaging MEMS microphone, the MEMS microphone chip is provided by: sequentially forming a metal layer and a conductive layer on the MEMS microphone chip; patterning the metal layer and the conductive layer to respectively form the metal pad and a conductive protection layer; forming a dielectric layer, fully covering over the metal pad and the protection layer; and patterning the dielectric layer to have an opening to expose the conductive protection layer. An end portion of the bonding wire in the bonding process within the opening is penetrating the conductive protection layer and connected to the metal pad. The dielectric layer with the conductive protection layer forms the protection layer on the metal pad.

In an embodiment, as to the method for packaging MEMS microphone, the conductive layer comprises a single-layer conductive layer or a conductive layer with a glue layer on the metal pad.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A package structure of micro-electro-mechanical-system (MEMS) microphone, comprising:

a MEMS microphone chip, disposed on a circuit board, wherein the MEMS microphone chip comprises a first bonding pad, the first bonding pad comprises:

a metal pad on a top of the MEMS microphone chip; and a protection layer, fully enclosing a sidewall of the metal pad and also partially disposed on a top of the metal pad;

a circuit chip, disposed on the circuit board, wherein the circuit chip comprises a second bonding pad; and a bonding wire, connected between the first bonding pad and the second bonding pad.

2. The package structure as recited in claim 1, wherein the metal pad contains aluminum and the protection layer contains TiN.

3. The package structure as recited in claim 1, wherein the protection layer provides a barrier capability from corrosion of the metal pad.

4. The package structure as recited in claim 1, wherein the MEMS microphone chip comprise:

a silicon substrate;

a MEMS structure, disposed on the silicon substrate;

a circuit layer, disposed on the silicon substrate, the circuit layer connected to the MEMS structure; and the first boding pad, disposed on the circuit layer.

5. The package structure as recited in claim 1, wherein the bonding wire is a gold wire.

6. The package structure as recited in claim 1, wherein the first boding pad comprises an anode pad and a cathode pad of the MEMS microphone chip.

7. The package structure as recited in claim 1, wherein an end portion of the bonding wire is disposed on the top of the metal pad and the protection layer comprises a conductive layer at least covering on the top of the metal pad enclosing the end portion of the bonding wire.

8. The package structure as recited in claim 7, wherein the conductive layer further comprises a portion fully enclosing the sidewall of the metal pad.

9. The package structure as recited in claim 7, wherein the protection layer further comprises a dielectric layer fully enclosing the sidewall of the metal pad.

10. The package structure as recited in claim 9, wherein the dielectric layer further covers a peripheral region of the conductive layer on the top of the of the metal pad.

11. The package structure as recited in claim 7, wherein the conductive layer contains TiN and the metal pad contains aluminum.

12. The package structure as recited in claim 1, wherein the protection layer comprises a single-layer conductive layer or a conductive layer with a glue layer on the metal pad.

13. A package structure of micro-electro-mechanical-system (MEMS) microphone, comprising:

a MEMS microphone chip, disposed on a circuit board, wherein the MEMS microphone chip comprises a first bonding pad, the first bonding pad is located on a top of the MEMS microphone chip;

a circuit chip, disposed on the circuit board, wherein the circuit chip comprises a second bonding pad;

a bonding wire, connected between the first bonding pad and the second bonding pad;

a sealant structure, locally covering on the first bonding pad and an end portion of the bonding wire on the first bonding pad.

14. The package structure as recited in claim 13, wherein the bonding pad contains aluminum.

15. The package structure as recited in claim 13, wherein the sealant structure comprises a glob top structure.

16. A method for packaging micro-electro-mechanical-system (MEMS) microphone, comprising:

providing a circuit board, a MEMS microphone chip and a circuit chip, wherein the MEMS microphone chip comprises a first bonding pad, the circuit chip comprises a second bonding pad, the first bonding pad comprises:

a metal pad on a top of the MEMS microphone chip; and a protection layer fully enclosing a sidewall of the metal pad and also partially disposed on a top of the metal pad;

disposing the MEMS microphone chip and the circuit chip on the circuit board; and performing a bonding process to connect between the first bonding pad and the second bonding pad by a bonding wire.

17. The method for packaging MEMS microphone in claim 16, wherein the metal pad contains aluminum and the protection layer contains TiN.

18. The method for packaging MEMS microphone in claim 16, wherein the protection layer provides a barrier capability from corrosion of the metal pad.

19. The method for packaging MEMS microphone in claim 16, wherein an end portion of the bonding wire in the bonding process is disposed on the top of the metal pad and the protection layer comprises a conductive layer at least covering on the top of the metal pad enclosing the end portion of the bonding wire.

20. The method for packaging MEMS microphone in claim 16, wherein the MEMS microphone chip is provided by:

forming the metal pad on the top of the MEMS microphone chip;

forming a conductive layer, covering on the MEMS microphone chip and the metal pad; and removing a side portion of the conductive layer, wherein a residual portion of the conductive layer serves as the protection layer to fully cover the top and a sidewall of the metal pad, wherein an end portion of the bonding wire in the bonding process is penetrating the protection layer and connected to the metal pad.

21. The method for packaging MEMS microphone in claim 16, wherein the MEMS microphone chip is provided by:

sequentially forming a metal layer and a conductive layer on the MEMS microphone chip;

patterning the metal layer and the conductive layer to respectively form the metal pad and a conductive protection layer;

forming a dielectric layer, fully covering over the metal pad and the protection layer; and patterning the dielectric layer to have an opening to expose the conductive protection layer, wherein an end portion of the bonding wire in the bonding process within the opening is penetrating the conductive protection layer and connected to the metal pad, wherein the dielectric layer with the conductive protection layer forms the protection layer on the metal pad.

22. The method for packaging MEMS microphone in claim 16, wherein the conductive layer comprises a single-layer conductive layer or a conductive layer with a glue layer on the metal pad.

* * * * *